US006959760B1

(12) United States Patent
Braithwaite et al.

(10) Patent No.: US 6,959,760 B1
(45) Date of Patent: Nov. 1, 2005

(54) DOWNHOLE PULSER

(75) Inventors: Stephen Richard Braithwaite, Rijswijk (NL); Wilhelmus Hubertus Paulus Maria Heijnen, Velsen (NL)

(73) Assignee: Shell Oil Company, Houston, TX (US)

( * ) Notice: Subject to any disclaimer, the term of this patent is extended or adjusted under 35 U.S.C. 154(b) by 23 days.

(21) Appl. No.: 10/148,113

(22) PCT Filed: Nov. 28, 2000

(86) PCT No.: PCT/EP00/12003

§ 371 (c)(1),
(2), (4) Date: Jul. 9, 2002

(87) PCT Pub. No.: WO01/40622

PCT Pub. Date: Jun. 7, 2001

(30) Foreign Application Priority Data

Nov. 29, 1999 (EP) ..... 99204026

(51) Int. Cl.[7] ..... E21B 28/00; E21B 4/14; E21B 43/00; B23Q 5/00

(52) U.S. Cl. ..... 166/177.6; 166/63; 166/177.7; 166/249; 166/383; 175/93; 173/19; 173/153; 173/155

(58) Field of Search ..... 166/301, 373, 166/381, 383, 65.1, 177.6, 177.7, 178, 63, 248, 249; 175/93; 173/4, 17, 19, 153, 155

(56) References Cited

U.S. PATENT DOCUMENTS 2,396,627 A * 3/1946 Wohlmeyer ..... 123/46 SC
2,875,737 A * 3/1959 Ueckert ..... 123/41.56
2,948,122 A * 8/1960 Smith ..... 173/131
2,950,705 A * 8/1960 Kuhn ..... 123/46 SC
3,096,833 A * 7/1963 Bodine ..... 175/56
3,797,585 A * 3/1974 Ludvigson ..... 173/131
4,051,909 A * 10/1977 Baum ..... 175/93
4,280,557 A 7/1981 Bodine
4,583,601 A 4/1986 Techy
4,865,125 A * 9/1989 De Cuir ..... 166/178
5,009,272 A * 4/1991 Walter ..... 175/56
5,503,228 A * 4/1996 Anderson ..... 166/301
5,595,243 A 1/1997 Maki et al.
6,502,638 B1 * 1/2003 Stoesz ..... 166/301

* cited by examiner

*Primary Examiner*—David Bagnell
*Assistant Examiner*—Jennifer Gay

(57) ABSTRACT

A power generator for use in a wellbore formed in an earth formation, including an internal combustion engine having a cylinder and a piston defining a combustion chamber in the cylinder, the engine being arranged to induce a reciprocating movement to the piston relative to the cylinder upon combustion of a combustible gas mixture in the combustion chamber, and a linear electricity generator having a stator and a drive shaft. The generator is arranged to generate electricity upon a reciprocating movement of the drive shaft relative to the stator, and the piston is connected to the drive shaft so as to transmit the reciprocating movement of the piston to the drive shaft.

8 Claims, 2 Drawing Sheets

DOWNHOLE PULSER

FIELD OF THE INVENTION

The present invention relates to a pulser for generating pressure pulses in a wellbore formed in an earth formation.

BACKGROUND OF THE INVENTION

Hydrocarbon fluid is generally produced from an earth formation using a wellbore provided with a casing or liner having perforations at the level of the producing formation. The hydrocarbon fluid flows through the pores of the earth formation and the perforations into the wellbore.

A problem frequently encountered during production is that the pores of the formation are naturally clogged by fine solids or diagenetic mineral particles, or become clogged by fines solid particles in the course of hydrocarbon fluid production, thereby decreasing the flow rate and increasing the flow resistance. Another frequently encountered problem is that the perforations extending into the earth formation are contaminated by crushed or fused rock particles as a result of the use of shaped explosive charges to create the perforations, or by residual material from such shaped explosive charges. Such particles and residual materials impede the flow rate of hydrocarbon fluid.

It is an object of the invention to provided a device for reducing, or eliminating, the problem of reduced flow rate due to clogging of the pores of the earth formation.

SUMMARY OF THE INVENTION

In accordance with the invention there is provided a pulser for generating pressure pulses in a wellbore formed in an earth formation, comprising a housing provided with an internal combustion engine including a cylinder and a piston arranged to perform a combustion stroke upon combustion of a combustible gas mixture in the cylinder, a first spring arranged to induce the piston to perform a compression stroke upon completion of the combustion stroke, the pulser further comprising a hammer connected to the piston, an anvil movable relative to the housing between a fist position and a second position in which the pulser has a different volume than in the first position, the anvil being arranged so that the hammer impacts against the anvil during the combustion stroke and induces the anvil to move from the first to the second position, and a second spring biasing the anvil from the second to the first position thereof.

By the impact of the hammer against the anvil during each combustion stroke, the anvil rapidly moves to the second position and thereby creates a pressure pulse in the fluid present in the wellbore by virtue of the sudden change of volume of the pulser. In this manner a sequence of pressure pulses is generated, which pulses travel into the pores of the earth formation and thereby prevent settling of fine solid particles in the pores.

BRIEF DESCRIPTION OF THE DRAWINGS

The invention will be further described in more detail and by way of example with reference to the accompanying drawings in which FIG. 1 schematically shows an embodiment of the pulser according to the invention.

DETAILED DESCRIPTION

Figure 1:
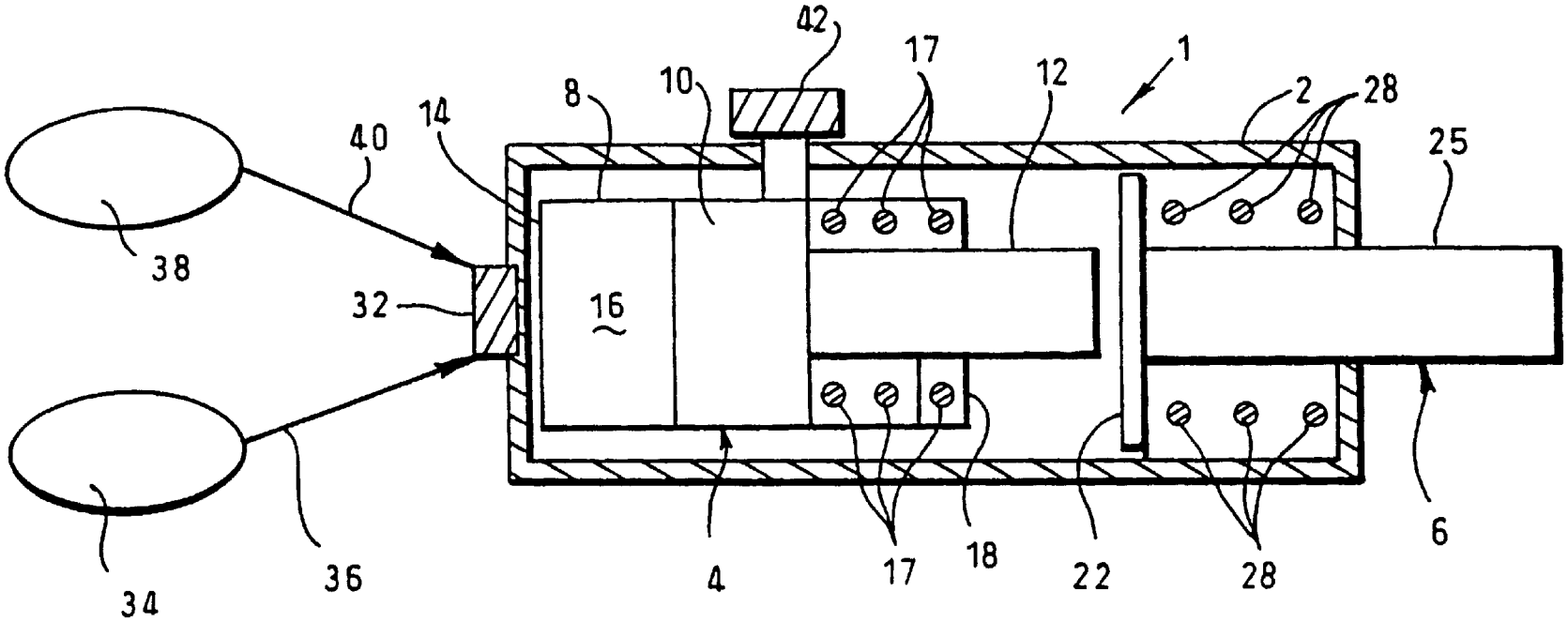

Referring to FIG. 1 there is shown a pulser 1 for use in a wellbore (not shown) formed in an earth formation (not shown). The pulser 1 includes a housing 2 provided with an internal combustion engine 4 and an anvil 6 having a common longitudinal axis coinciding with, or parallel to, the longitudinal axis of the wellbore.

The engine 4 comprises a cylinder 8 and a piston 10 extending into the cylinder 8 and being movable relative to the cylinder 8 in longitudinal direction thereof. A hammer 12 connected to the piston 10 extends in longitudinal direction to the anvil 6. The cylinder 8 is at the end thereof opposite the hammer 12 closed by an end wall 14, thereby defining a combustion chamber 16 formed in the cylinder 8 between the piston 10 and the end wall 14. A compression spring 17 biased between the piston 10 and an annular shoulder 18 of the cylinder 8, biases the piston 10 to a retracted position in which the combustion chamber 16 has a relatively small volume. The combustion chamber 16 is provided with a glow plug (not shown) connected to a battery (not shown) for temporarily cheating the glow plug.

The anvil 6 includes an anvil plate 22 arranged within the housing and an anvil shaft 25 fixedly connected to the anvil plate 22, the anvil shaft 25 extending through an opening provided in the housing 2 in a manner allowing the anvil 6 to move in longitudinal direction relative to the housing 2 between a retracted position in which the pulser 1 has a first volume and an extended position in which the pulser 1 has a second volume larger than the first volume. A spring 28 biases the anvil 6 to the retracted position thereof. The relative arrangement of the anvil 6 and the engine 4 is such that the anvil plate 22 is located a short distance from the hammer 12 when both the engine 4 and the anvil 6 are in their respective retracted positions.

Figure 2:
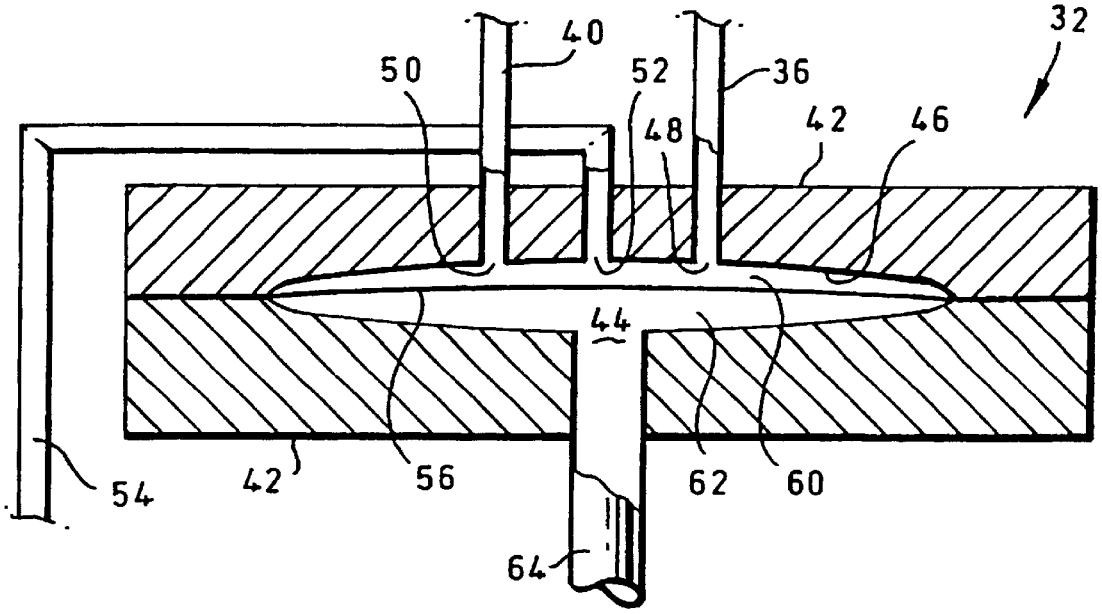
FIG. 2 schematically shows in inlet valve of the embodiment of FIG. 1.

Referring further to FIG. 2 there is shown an inlet valve 32 of the engine 4. The inlet valve 32 is in fluid communication with an oxygen reservoir 34 via a conduit 36 and with a hydrogen reservoir 38 via a conduit 40. The oxygen reservoir 34 contains a supply of oxygen at a selected pressure, and the hydrogen reservoir 38 contains a supply of hydrogen at a selected pressure. The inlet valve 32 includes a valve body 42 provided with a disc shaped chamber 44 having a valve seat surface 46 provided with a first opening 48 in fluid communication with the conduit 36, a second opening 50 in fluid communication with the conduit 40, and a third opening 52 in fluid communication with an inlet opening (not shown) provided in the wall of the cylinder 8 via a conduit 54. The position of the inlet opening is such that the piston 10 covers the inlet opening during an initial stage of the combustion stroke, and uncovers the inlet opening during a final stage of the combustion stroke. A membrane 56 divides the disc shaped chamber 44 in a first zone 60 in fluid communication with the respective openings 48, 50, 52 and a second zone 62 in fluid communication with the combustion chamber 16 via a conduit 64. The membrane 56 is flexible so as to allow the membrane to lay against the valve seat surface 46 if a fluid pressure in zone 62 exceeds a fluid pressure in zone 60.

Figure 3:
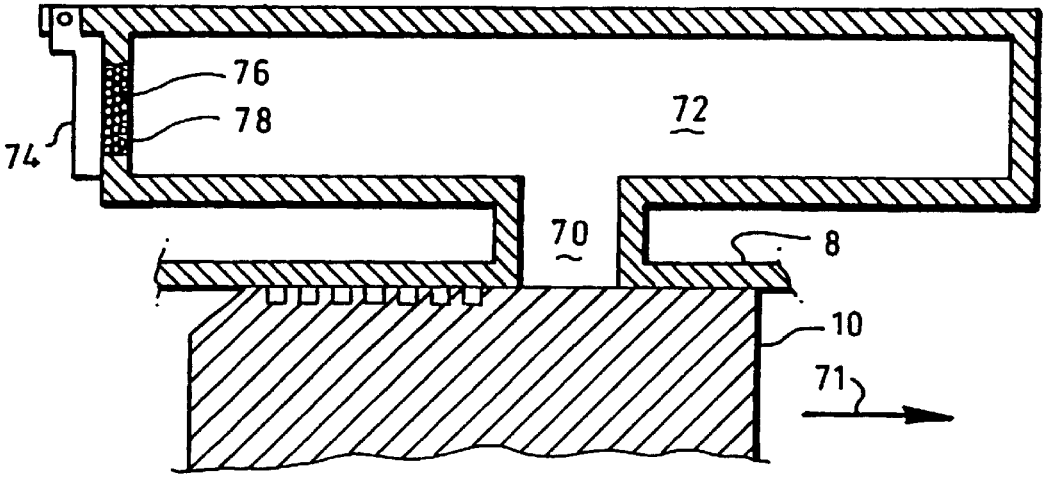
FIG. 3 schematically shows an exhaust of the embodiment of FIG. 1.

In FIG. 3 is an exhaust of the engine 4, which exhaust includes an outlet opening 70 formed in the wall of the cylinder 8. For reference purposes the piston 10 is shown together with the direction of movement 71 of the piston 10 during a combustion stroke thereof. The position of the outlet opening 70 is such that the piston covers the outlet opening 70 during an initial stage of the combustion stroke, and uncovers the outlet opening 70 during a final stage of the combustion stroke. The outlet opening 70 is in fluid communication with an expansion chamber 72 provided with a non-return valve 74 allowing combusted gas to flow from the expansion chamber 72 via the non-return valve 74 to the exterior of the engine 4 and preventing inflow of fluid from exterior the engine 4 into the expansion chamber 72. The non-return valve 74 includes a passage 76 for combusted gas, which passage 76 is provided with a body of permeable material 78 including sintered steel.

During normal operation a stream of oxygen flows from the oxygen reservoir 34 via the conduit 36 into the first zone 60 of the chamber 44 and a stream of hydrogen flows from the hydrogen reservoir 38 via the conduit 40 into the first zone 60. In said first zone the streams of oxygen and hydrogen mix to form a stream of combustible gas mixture which flows via the conduit 54 into the combustion chamber 16. Ignition of the gas mixture is achieved by inducing the battery to provide an electric current to the glow plug. Upon ignition of the gas mixture, the piston 10 performs a combustion stroke in the direction of arrow 71 thereby compressing the spring 17 and moving the hammer 12 in longitudinal direction towards the anvil plate 22. Continued movement of the hammer 12 causes the hammer 12 to impacts on the anvil plate 22 thereby moving the anvil 6 from the retracted position to the extended position thereof. The piston 10 uncovers the inlet opening and the outlet opening 70 during the final stage of the combustion stroke, thus allowing the combusted gas to flow via the outlet opening 70 into the expansion chamber 72. The combusted gas expands in the expansion chamber 72 and flows from there via the non-return valve 74 to the exterior of the power generator 1, thereby passing through the body of permeable material 78. The non-return valve 74 and the body of permeable material 78 prevent fluid outside the power generator from entering the expansion chamber 72.

As the combusted gas flows out of the combustion chamber 16, the pressure in the combustion chamber drops to a level below the pressure of oxygen in the oxygen reservoir 34 and hydrogen in the hydrogen reservoir 38. As a result another stream of oxygen flows from the oxygen reservoir 34 via the conduit 36 into the first zone 60 of the chamber 44 and a stream of hydrogen flows from the hydrogen reservoir 38 via the conduit 40 into the first zone 60. In said first zone the streams of oxygen and hydrogen mix to form a fresh stream of combustible gas mixture which flows via the conduit 54 into the combustion chamber 16.

Upon completion of the combustion stroke, the spring 17 induces the piston 10 to perform a compression stroke whereby the piston 10 compresses the combustible gas mixture in the combustion chamber 17. During the compression stroke the pressure in the combustion chamber 16 rises to a level above the selected pressure of oxygen and hydrogen in the respective reservoirs 34, 38. Consequently the membrane 54 is biased against the valve seat surface 46 thereby closing the openings 48, 50, 52. Further inflow of combustible gas mixture into the combustion chamber 16 is thereby prevented. When the piston 10 arrives at the end of the compression stroke the pressure in the combustion chamber 17 is at a level causing the glow plug, which is still hot as a result of the previous combustion cycle, to ignite the combustible gas mixture thereby inducing the piston 10 to perform another combustion stroke.

Simultaneously with the compression stroke of the piston 10, the spring 28 biases the anvil 6 back to its retracted position.

The engine then automatically performs a sequence of combustion cycles, each combustion cycle including a compression stroke followed by a combustion stroke of the piston 10, as described above. The 12 hammer impacts on the anvil plate 22 during each combustion stroke of the piston 10, thereby causing a reciprocating movement of the anvil relative to the housing 2. As a consequence the anvil shaft 25 causes a sequence of pressure pulses in the wellbore fluid, which pressure pulses travel to the pore fluid in the earth formation and prevent the pores of the formation from becoming clogged.

We claim:

1. A pulser for generating pressure pulses in a wellbore formed in an earth formation to generate pressure pulses in said wellbore, the pulser comprising a housing provided with an internal combustion engine including a cylinder and a piston arranged to perform a combustion stroke upon combustion of a combustible gas mixture in the cylinder, a first spring arranged to induce the piston to perform a compression stroke upon completion of the combustion stroke, the pulser further comprising a hammer connected to the piston, an anvil movable relative to the housing between a first position and a second position in which the pulser has a different volume than in the first position, the anvil being arranged so that the hammer impacts against the anvil during the combustion stroke and induces the anvil to move from the first to the second position, and a second spring biasing the anvil from the second to the first position thereof.

2. The pulser of claim 1, wherein the anvil extends through an opening provided in the housing to outside the housing, and wherein in the second position of the anvil the length of the part of the anvil extending outside the housing is larger in the first position.

3. The pulser of claim 1, wherein the engine is provided with an inlet valve arranged to allow a stream of combustible gas mixture to enter the cylinder if the fluid pressure in the stream exceeds the fluid pressure in the cylinder.

4. The pulser of claim 3, wherein the inlet valve comprises a valve body having a valve seat surface provided with at least one opening for supplying the combustible gas mixture to the combustion chamber, and a membrane arranged to cover each opening if the fluid pressure in the stream is lower than the fluid pressure in the cylinder.

5. The pulser of claim 4, wherein the valve seat surface is provided with a first opening in fluid communication with an oxygen reservoir, a second opening in fluid communication with a hydrogen reservoir, and a third opening in fluid communication with the combustion chamber, the membrane being arranged to cover the first, second and third openings if the fluid pressure in the stream is less than the fluid pressure in the cylinder.

6. The power generator of claim 1, wherein the engine is provided with an outlet for combusted gas, the outlet including an outlet opening arranged in the wall of the cylinder, the outlet opening debouching into an expansion chamber provided with a non-return valve allowing combusted gas to flow from the expansion chamber via the non-return valve to the exterior of the engine and preventing inflow of fluid from exterior the engine into the expansion chamber.

7. The power generator of claim 6, wherein the expansion chamber is provided with a passage for combusted gas, the passage being provided with a body of permeable material.

8. The power generator of claim 7, wherein the permeable material comprises sintered steel.

* * * * *